US005372055A

United States Patent [19]

Kelly et al.

[11] Patent Number: 5,372,055

[45] Date of Patent: * Dec. 13, 1994

[54] ROD ROTATING TOOL

[75] Inventors: Michael W. Kelly, Joliet, Ill.; Glenn F. Jorgensen, Ridgewood, N.J.

[73] Assignees: Power House Tool Inc., Joliet, Ill.; JNT Technical Services, Inc., Little Perry, N.J.

[ * ] Notice: The portion of the term of this patent subsequent to Oct. 19, 2010 has been disclaimed.

[21] Appl. No.: 53,424

[22] Filed: Apr. 28, 1993

Related U.S. Application Data

[63] Continuation-in-part of Ser. No. 974,945, Nov. 12, 1992, Pat. No. 5,253,556.

[51] Int. Cl.[5] ..... B25B 13/48

[52] U.S. Cl. ..... 81/53.2; 277/43.2; 277/43.4

[58] Field of Search ..... 81/53.2; 279/43, 43.2, 279/43.4

[56] References Cited

U.S. PATENT DOCUMENTS

| | | |
|---|---|---|
| 574,077 | 12/1896 | Sellers . |
| 603,825 | 5/1898 | Barber . |
| 801,767 | 10/1905 | Cleveland . |
| 915,184 | 3/1909 | Keirn . |
| 958,980 | 5/1910 | Thomas . |
| 1,279,349 | 9/1918 | Johnson . |
| 1,425,359 | 8/1922 | Barry . |
| 1,492,466 | 4/1924 | Jarmolowsky . |
| 1,498,040 | 6/1924 | Johnson . |
| 1,499,701 | 7/1924 | Skeel . |
| 1,514,357 | 11/1924 | Whelan . |
| 1,566,691 | 12/1925 | Perry . |
| 1,583,554 | 5/1926 | Hoover . |
| 1,694,628 | 12/1928 | Sauveur . |
| 1,815,500 | 7/1931 | Doan . |
| 1,818,626 | 8/1931 | Johnston . |
| 2,086,167 | 7/1937 | Lamb . |
| 2,390,034 | 11/1945 | Walker . |
| 2,391,624 | 12/1945 | Heuer . |
| 2,497,214 | 2/1950 | Dreyer . |
| 2,701,489 | 2/1955 | Osborn . |
| 2,798,392 | 7/1957 | Randolph . |
| 3,104,569 | 9/1963 | Davis et al. . |
| 3,529,497 | 9/1970 | Brooks . |
| 4,603,605 | 8/1986 | Miller . |
| 4,651,596 | 3/1987 | Rachanski . |
| 4,777,850 | 10/1988 | Polonsky . |
| 5,152,195 | 10/1992 | Merrick . |

*Primary Examiner*—James G. Smith

*Attorney, Agent, or Firm*—Hill, Steadman & Simpson

[57] ABSTRACT

A tool for rotating a rod is provided which is formed of three members. A first member is formed as a sleeve and has an internal opening size to receive the rod. This sleeve has a tapered, portion which is placed over the rod. A second member, which may also be in the form of a sleeve slips onto the first sleeve and engages against the tapered portion. A third member sleeve is axially fixed to one of the first and second members and engages against the other of the members. A mechanical arrangement is provided to selectively urge the third sleeve apart from the other members against which it engages in order to move the second member and the first member relative to one another along the tapered surfaces to collapse the end of the first member engaging the rod to increase the gripping force of the first member with the rod. The first member has a shaped contour for receiving a torque applying device, such as a wrench, so that the first member can be rotated, thus rotating the rod.

30 Claims, 3 Drawing Sheets

ROD ROTATING TOOL

This application is a continuation-in-part of U.S. Ser. No. 07/974,945, filed Nov. 12, 1992, now U.S. Pat. No. 5,253,556.

BACKGROUND OF THE INVENTION

The present invention relates to tools and in particular a tool for rotating a rod or post, such as a stud.

A threaded rod, such as a stud, oftentimes presents an assembly or disassembly problem in that there generally is no gripping surface on such a fastener against which to apply a torque force to rotate the fastener. This is particularly true when there are very close tolerances between the threaded fastener and the threaded opening into which it is threaded, requiring a high torque level for rotation of the fastener relative to material into which it is being inserted or from which it is being removed. Occasionally threaded rods, or studs, are placed into working environments wherein corrosive liquids or gases are present causing a locking or seizing to occur between the stud and the surrounding material, increasing the difficulty of removal of the stud.

Various mechanisms have been provided for assisting in the stud removal or inserting process. For example, U.S. Pat. No. 4,932,292 discloses a device which could be used to remove a stud. This device employs an arrangement of loose jaws which engage against ramp surfaces to selectively move the jaws radially inwardly to grip a central post when the tool is rotated in one rotational direction. Rotation in an opposite direction will cause the jaws to loosen from the post. Therefore, such a device can be used only to rotate the post in one rotational direction.

U.S. Pat. No. 2,351,232 discloses a stud setting and removing tool which utilizes a split collet to engage the stud with an outer sleeve to radially compress the collet. A threaded member engages with the sleeve to press against the collet to move the collet relative to the sleeve.

It would be an advance in the art if there were provided an easy to use tool for readily rotating a rod in either rotational direction.

SUMMARY OF THE INVENTION

A tool in accordance with the principles of the present invention comprises three sleeve members. A first sleeve member has an internal passage for receiving the rod or stud. The passage may or may not extend entirely through the first sleeve. The first sleeve has a drive arrangement at a first end for engagement by a torque applying tool such as a wrench. In an embodiment of the invention a second end of the sleeve has an outer surface flared outwardly and has a plurality of slits extending axially toward the first end. In another embodiment the sleeve has a cylindrical outer surface with a plurality of radially movable inserts extending through the cylindrical surface, the inserts moving outer surfaces flared or tapered outwardly toward the second end. This sleeve is to be slipped onto or threaded onto the rod which is to be rotated. A second sleeve has an internal diameter larger than an external threaded portion of the first sleeve, but less than the outwardly flared diameter at the first sleeve's second end. This second sleeve, which can be in the form of a ring, is slipped onto the first sleeve until it engages against the flared portion of the first sleeve.

In a preferred embodiment, a third sleeve has an internal thread which engages with the external thread of the first sleeve. The third sleeve is threaded down towards the second sleeve. The third sleeve also carries longitudinally extendable members, for example in the form of jack screws, which engage against the second sleeve. Once the second sleeve has been threaded, hand tight, to where it engages the second sleeve, the extendable members are then extended to press against the second sleeve causing it to slide along the flared portion of the first sleeve, resulting in the first sleeve or the inserts being pressed inwardly which is accommodated by the longitudinal slits or use of separate inserts. The inward pressing of the first sleeve or inserts against the rod greatly increases the frictional engagement between the first sleeve or inserts and the rod. Thus when the first sleeve is rotatably driven, the rod rotates as well. The interior surface of the first sleeve or inserts can either be threaded to match the thread of the rod, or can have some other friction enhancing contour, such as a series of longitudinal splines or knurls to enhance the frictional engagement between the first sleeve or inserts and the rod.

DETAILED DESCRIPTION OF THE PREFERRED EMBODIMENTS

Figure 1:
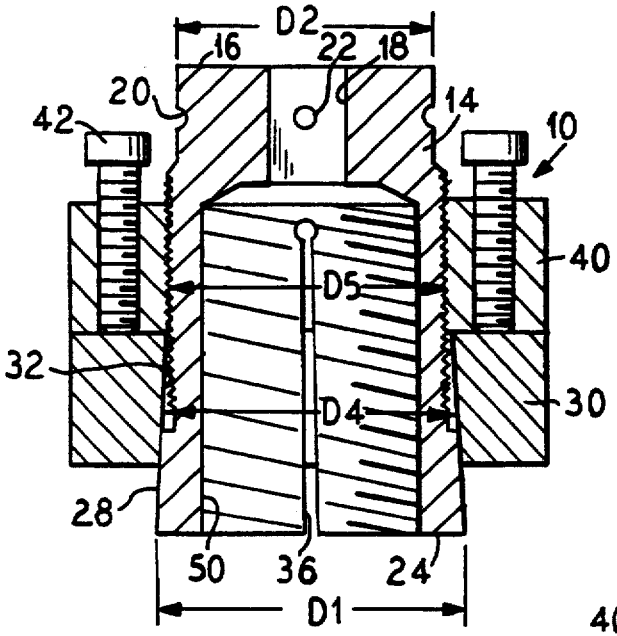
FIG. 1 is a side sectional view of a tool embodying the principles of the present invention with the third sleeve engaging the second sleeve.

In FIGS. 1–10 a tool is illustrated generally at 10 which is useful in applying a rotational torque to a post or rod member 12 (FIG. 2), preferably a threaded rod such as a stud. The tool 10 is comprised of a first sleeve member or collet 14 which is generally cylindrical. The sleeve member 14 has a first end 16 which has a surface configuration adapted to receive a torque applying driving type tool. In the embodiment illustrated in the drawings, a square opening 18 is provided for receipt of a square drive impact wrench. Such a wrench typically has an arrangement for locking on to a tool which requires the use of a groove 20 and apertures 22 for receipt of a locking pin. Many other types of surface configurations can be utilized including a hexagonal shaped outer periphery, a spline drive shape, a castellated drive shape, etc.

The first sleeve 14 has a second end 24 with an outside diameter $D_1$ greater than a diameter $D_2$ of the first end. A central portion 26 of the first sleeve 14 has a diameter $D_3$ which also is less than the diameter $D_1$ of the second end 24. In the preferred embodiment illustrated in FIGS. 1 and 2, the central portion 26 has an external thread thereon. The thread terminates prior to the second end 24. A portion 28 of the first sleeve 14 extending from the threaded portion 26 to the second end 24 is flared outwardly and downwardly (as illustrated) beginning at a step 29 thus providing the increased diameter $D_1$ at the second end 24. The angle of the flare is preferably in the range of 3–6°. The first sleeve 14 has a plurality of longitudinal slots 36 therein which extend from the first end 24 toward the first end 16, but stopping short of the first end. Preferably the slits extend along 60–80% of the length of the first sleeve.

A second sleeve member 30 is provided which has an inside diameter $D_4$ which is greater than diameters $D_2$ and $D_3$, but less than diameter $D_1$. The second sleeve 30 can have an axial length shorter than its diameter, thus giving it the appearance of a ring.

Figure 5:
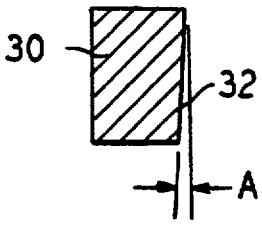
FIG. 5 is a side sectional view of the split second sleeve showing the angle of the interior diameter.
Figure 3:
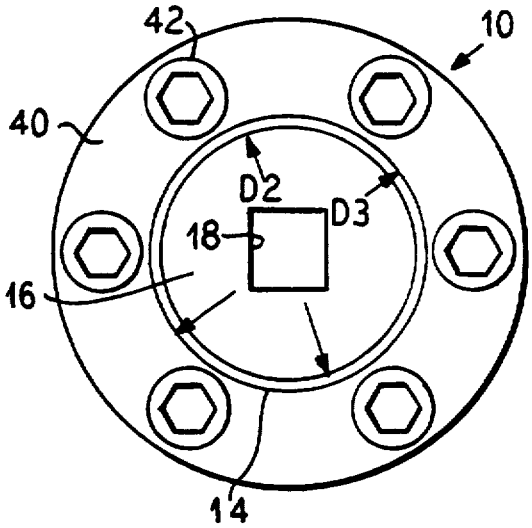
FIG. 3 is a top end elevational view of the tool in FIG. 1.

The second sleeve 30 is positioned on the first sleeve 14 by sliding the second sleeve along the first sleeve until the inside diameter $D_4$ of the second sleeve 30 engages against the flared portion 28 of the first sleeve 14. In a preferred embodiment, as best illustrated in FIG. 5, an inside wall 32 of the second sleeve 30 has an angle A which is the same angle as the flare of portion 28 in order to allow surface contact between sleeve 30 and sleeve 14 and to avoid point contact therebetween. It is also preferred to provide a lubricant, such as graphite, to the flared portion 28 to reduce the sliding friction between the first 14 and second 30 sleeves.

A third sleeve member 40 has an internal diameter $D_5$ which is essentially identical to or slightly greater than diameter $D_3$. In the preferred embodiment of FIGS. 1 and 2, the internal diameter $D_5$ of the third sleeve 40 is threaded to match the thread on the threaded portion 26 of the first sleeve until it engages the second sleeve. Thus, the third sleeve, which may be in the form of a ring, can be threaded on to the exterior of the first sleeve. Thus, when the third sleeve 40 is positioned on the first sleeve 14, it is prevented from moving axially relative to the first sleeve. Although a threaded connection is illustrated, any other type of mechanical arrangement can be utilized to secure the third sleeve 40 axially relative to the first sleeve 14, once the third sleeve is put into place. Threaded fasteners (FIG. 6), clamps (FIG. 7), set screws (FIG. 10), engaging flanges (FIGS. 8 and 9), etc. could be used. If a threaded engagement is used, again, a lubricant such as graphite should be applied to the mating surfaces of the first and third sleeves.

The third sleeve 40 carries on it or receives one or more longitudinally extendable members 42. In the preferred embodiment illustrated in FIGS. 1–3, the extendable members 42, may be in the form of jack bolts as described in U.S. Pat. No. Re 33,490, incorporated herein by reference. Preferably the bolts 42 are sequentially tightened which causes them to press against the second sleeve 30 to press and slide it downwardly against the flare portion 28. Again, although jack bolts are illustrated in FIGS. 1–3 and 9 as the extendable members, other mechanisms could be used including levers (FIG. 8), rack and pinion devices (FIG. 7), ratchet devices (FIG. 8), hydraulic nuts (FIG. 6), etc.

Due to the provision of the slits 36 in the first sleeve 14, the first sleeve will be moved radially inwardly as the second sleeve 30 moves downwardly along the flared surface, thus causing a gripping engagement between an inner surface 50 of the first sleeve 14 and the rod 12. Once a sufficiently tight engagement between the first sleeve 14 and the rod 12 is achieved, a tool can be applied to the first sleeve 14 to apply a torque force to cause the first sleeve 14 and thus the rod 12 to rotate. Rotation of the rod 12 can thus be effected in either direction permitting this tool to be used in loosening or tightening such a threaded rod.

Figure 2:
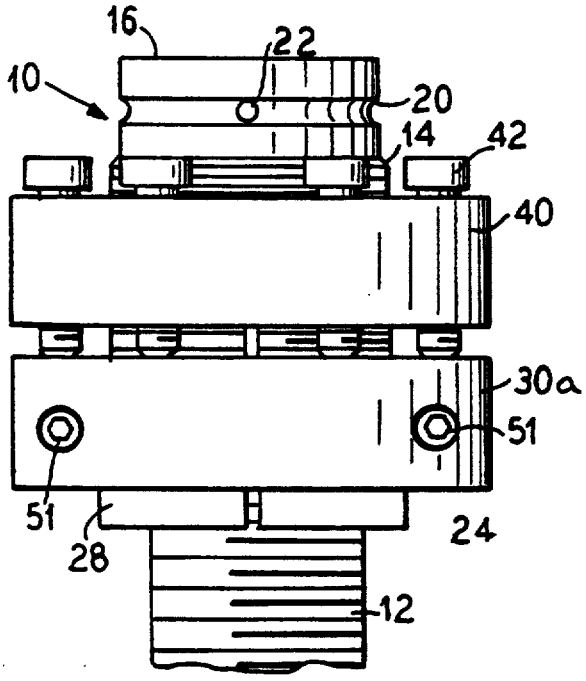
FIG. 2 .is a side elevational view of the tool shown in FIG. 1 with the second sleeve being pressed onto the flared portion of the first sleeve.
Figure 4:
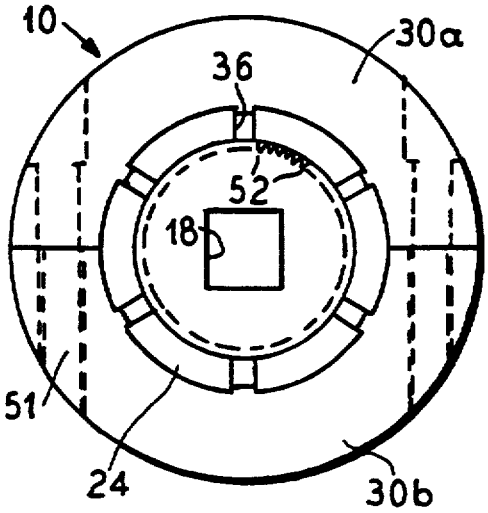
FIG. 4 is a bottom end elevational view of an alternate embodiment of the tool shown in FIG. 1.

To enable the second sleeve 30 to be easily removed from the flared end 28 of the first sleeve 14, as an option, the second sleeve can be formed as either a split ring or as two half rings 30*a*, 30*b* (FIGS. 2, 4). One or two lateral screws 51 can be used to initially hold the second sleeve 30 in a closed position. To facilitate removal, one or both of the screws 51 can be loosened to release the gripping force being applied by the second sleeve 30.

The inner surface 50 of the first sleeve 14 may be provided with a friction enhancing contour which may be a threaded surface as shown in FIG. 2 to match with threads on the rod 12, or could be of some other contour such as a series of splines 52 as illustrated in FIG. 4.

As mentioned above, there are a variety of alternate embodiments from the embodiment illustrated in FIGS. 1–4 relating to the manner in which the third sleeve 40 is retained on the first sleeve 14, as well as the particular type of axially extendable member arranged between the second sleeve 30 and the third sleeve 40 and the mechanism for acting upon the extendable member to cause it to extend.

Figure 6:
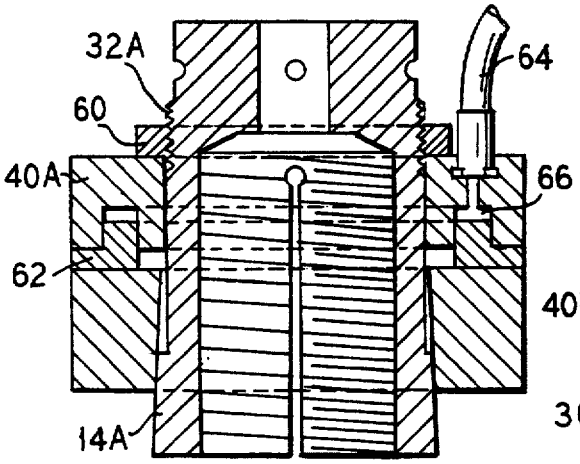
FIG. 6 is a side sectional view of an alternate embodiment of the engagement means between the first and third sleeves.

In FIG. 6 a first sleeve 14A has a relatively short external threaded portion 32A and a third sleeve 40A is not internally threaded. Rather, a threaded fastener 60 in the form of a locking ring is threadingly received on the threaded surface 32A to hold the third sleeve 40A in a fixed position relative to the first sleeve 14A.

In this embodiment, the third sleeve 40A comprises a hydraulic nut in which there is a separate ring member 62 which can be axially extended upon the introduction of a hydraulic fluid through an appropriate conduit 64 into a cavity 66 between the ring 62 and the body of the third sleeve 40A.

Introduction of hydraulic fluid under pressure will cause the ring 62 to move downwardly into engagement with the second sleeve 30 causing it, in turn, to move downwardly on the flared portion 28 of the first sleeve 14A and away from the third sleeve 40A.

Figure 7:
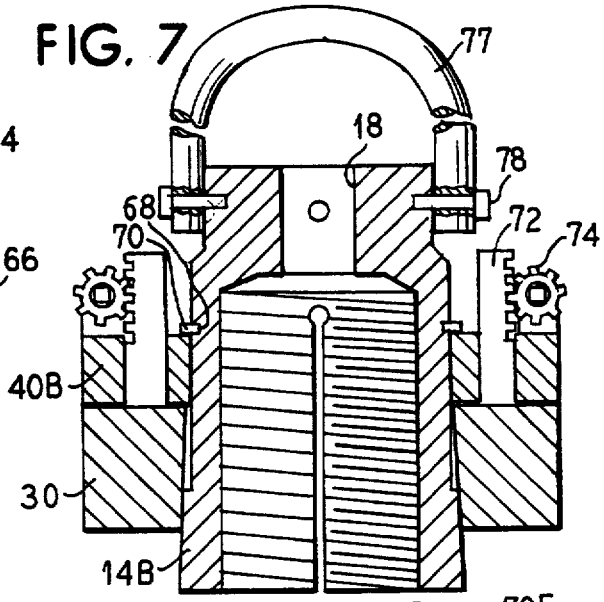
FIG. 7 is a side sectional view of another alternate embodiment of the means for urging the second and third sleeves apart.

In FIG. 7 a first sleeve 14B does not have any exterior thread. Instead, a groove 68 is provided for receiving a clamping device 70 which may be in the form of a snap ring which lies just above a third sleeve 40B. Thus, the snap ring 70 will prevent the third sleeve 40B from moving upwardly relative to the first sleeve 14B.

In FIG. 7 the axially extendable member comprises a rack 72 engaged by a pinion 74. A lower end 76 of the rack 72 engages or is integral with the second sleeve 30. Rotation of the pinion 74 will cause the rack 72 to move axially thus urging the second sleeve 30 and third sleeve 40B to move apart.

Also shown in FIG. 7 is an optional lifting ring 77 which may be used with larger sized tools to help move large rods, such as studs used in nuclear power plants which may weigh upwards of 800 pounds. The lifting ring 77 is pivotally connected to the first sleeve 14B by screws 78 or by other means well known in the art. The lifting ring 77 can thus be pivoted down to provide access to the square drive opening 18.

Figure 8:
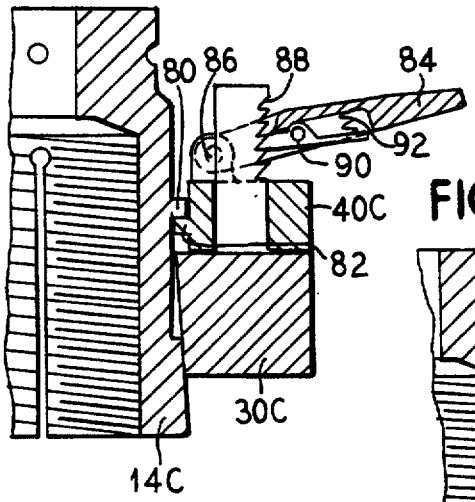
FIG. 8 is a partial side sectional view of an alternate embodiment of the engagement means between the first and third sleeves and the means for urging the second and third sleeves apart.

In FIG. 8 a first sleeve 14C is illustrated which has an external segmented flange 80 protruding outwardly therefrom. A third sleeve 40C has a segmented flange 82 extending inwardly therefrom. The two flanges 80, 82 are permitted to move past one another due to their segmented nature and then rotation of the third sleeve 40C relative to the first sleeve 14C will cause the two flanges 80, 82 to move into axial interference, such as in a bayonet type mount.

The third sleeve 40C carries a lever arm 84 which is pivotally attached to the third sleeve 40C at 86. In the arrangement shown in FIG. 8, a ratchet rack 88 extends axially into engagement with or integrally with the second sleeve 30C and is engageable by a pivotable dog 90 which is biased by means of a spring 92 into a engaging position with teeth 94 of the ratchet rack 88. Downward motion of the lever arm 84 will result in downward axial movement of the ratchet rack 88 urging the third sleeve 40C and second sleeve 30 apart. Overcoming the bias of spring 92 will permit the dog 90 to be released from the teeth 94 of the ratchet rack.

Figure 9:
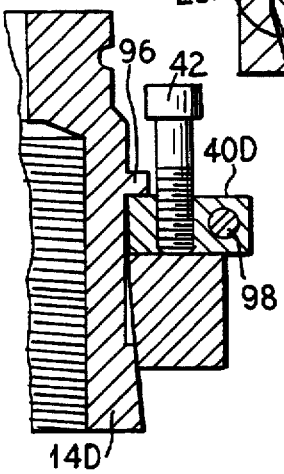
FIG. 9 is a partial side sectional view of an alternate embodiment engagement means between the first and third sleeves and the means for urging the second and third sleeves apart.

In FIG. 9 a first sleeve 14D has a continuous external flange 96 formed thereon. A third sleeve 40D is formed as a split ring, similar to the second sleeve 30A shown in FIGS. 2 and 3. One or more lateral screws 98 can be used to hold the third sleeve 40D in a closed position after it has been assembled onto the first sleeve 14D between the flange 96 and the second sleeve 30. In this embodiment, the axially extendable threaded fastener 42 is illustrated.

Figure 10:
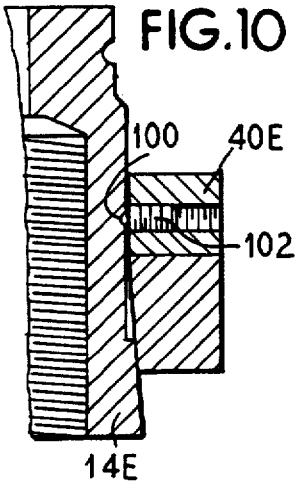
FIG. 10 is a partial side sectional view of an alternate embodiment of the engagement means between the first and third sleeves.

In FIG. 10 a first sleeve 14E is illustrated which has an outer surface that may be provided with one or more recesses or detents 100. A third sleeve 40E carries a horizontal set screw 102 with a point or tip which can be received in the detent 100 or which can grippingly engage an outer surface of the first sleeve 14E so as to lock the third sleeve 40E in a fixed axial position relative to the first sleeve 14E. Although there is not an axially extendable member illustrated in FIG. 10, it is only because it may be out of plane. Any of the axially extendable members described above could be used in this arrangement.

In fact, the particular combinations of means for fixing the third sleeve relative to the first sleeve and the means for causing the second sleeve and third sleeve to move apart are provided for illustrative purposes only. Any of the axial positioning means could be utilized with any one of the means for urging the second and third sleeves apart. Thus, a wide variety of combinations could be utilized within the scope of our invention.

Figure 11:
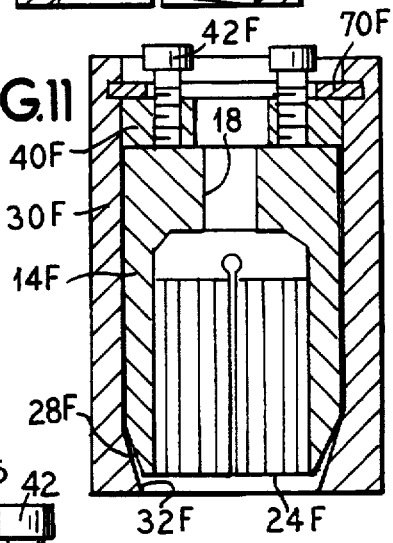
FIG. 11 is a side sectional view of an alternate embodiment of the arrangement of the parts of the invention.

FIG. 11 illustrates a further embodiment of the invention in which the parts have been rearranged slightly. A first member 14F which, again is in the form of a sleeve or collet is provided to engage the threaded rod and it is similar in many respects to the first sleeve 14 described above except that the taper of this member 14F shown at 28F decreases toward the first end 24F rather than increasing as described above. A second member 30F, which also may be in the form of a sleeve, surrounds the first member 14F as does the second sleeve 30 relative to the first sleeve 14 described above. An interior surface of the second member 30F at 32F is tapered with a complimentary shape to the tapered end of the first member 14F as described above.

A third member 40F which, in this illustration is also shown as a sleeve or ring, although it could be a plate member, is now provided on the interior of the second member 30F rather than on the exterior of the first member 14F as described above. Means 70F, which in this embodiment is shown as a snap ring, but which could be any type of retaining means as described above, assures that the third member 40F will be held in a fixed relationship relative to the second member 30F. Longitudinally extensible means 42F, here shown as jack bolts, but, again, which could be any of the extensible means described above, is provided to cause the third member 40F and first member 14F to be urged apart, thus causing the two complementary tapered surfaces 28F, 32F to be pressed together providing a radially inward force against the first member 14F causing the first member to grip the rod. Appropriate surface configurations for applying a rotating torque may be provided, in this embodiment, a square drive 18 in the first member 14F is illustrated.

Figure 13:
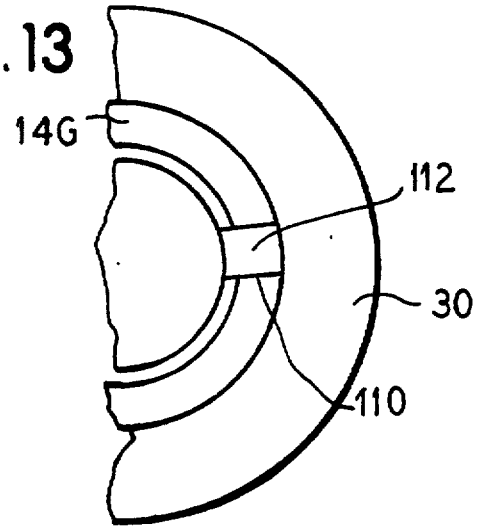
FIG. 13 is a top, partial sectional view taken generally along the line XIII—XIII of FIG. 12.
Figure 12:
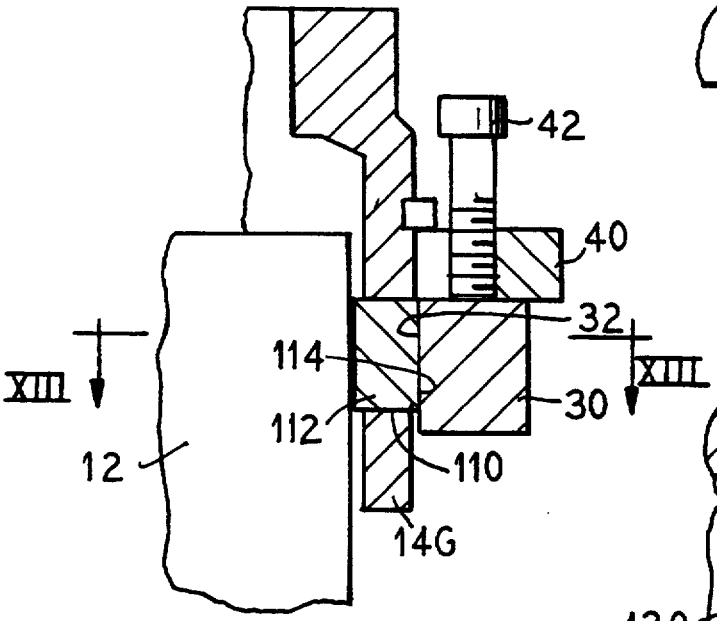
FIG. 12 is a side sectional view of an alternate embodiment of the present invention.
Figure 14:
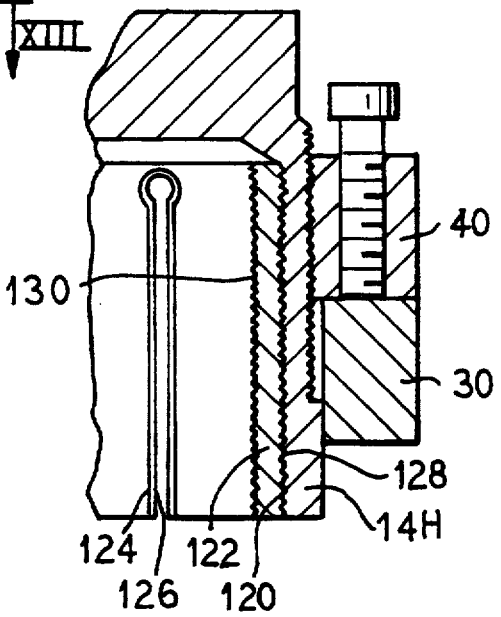
FIG. 14 is a partial side sectional view of an alternate embodiment of the invention showing an annular insert.

FIGS. 12–14 illustrate alternative embodiments of the invention in which one or more insert pieces are used to permit the tool to be used in connection with a wider range of rod diameters.

In FIG. 12 there is shown a first member 14G which varies from the first members described above in that the body of the member 14G does not have any taper, but rather the body has a plurality of openings 110 through which inserts 112 extend. Each of these inserts has a tapered outer wall 114 which is engaged by the tapered inner wall 32 of the second sleeve 30. As the second sleeve 30 is moved downwardly, for example by operation of jack screws 42, the inserts 112 are pressed radially inwardly to engage the stud 12. Since the individual insert members 112 are relatively small, insert members of differing radial dimensions can be utilized to cover a wide range of stud sizes with the use of a single first member 14G, second sleeve 30 and third sleeve 40.

An alternative arrangement is shown in FIG. 14 wherein a first member 14H is provided which is substantially similar to the first member 14 described above with respect to FIGS. 1–11 only with the exception that an interior surface 120 is threaded to receive an insert member 122 which is generally cylindrical in shape and which can include slots 124 to align with the slots 126 in the first member 14H to permit compression of the first member 14H and cylindrical insert 122. The cylindrical insert 122 has an exterior threaded surface 128 which threadingly mates with the interior threaded surface 120 of first member 14H. An interior surface 130 of the insert member may have a friction enhancing contour such as threads or grooves as described above.

Insert members 122 of differing thicknesses may be utilized to accommodate varying sized studs such that, similarly to the arrangement shown in FIGS. 12 and 13, only a single first member 14H, second member 30 and third member 40 need to be utilized to engage and rotate a wide range of rod sizes, while only changing the insert member.

Thus, it is seen that the present invention provides a first member having a first and second axial end, the second end being tapered and having a plurality of longitudinal slits extending from the second end and stopping short of the first end and an internal opening leading from the second end and sized to receive the rod with a minimum amount of play. A second member is provided which surrounds the first member and has an internal surface area shaped complimentarily to the tapered end of the first member. A third member is provided and means are provided which are engageable between the third member and one of the first and second members for retaining the third member and that one of the first and second members in a fixed positional relationship. Finally, means are provided for urging the third member and the other of the first and second members apart in an axial direction to cause a radial gripping or clamping of the first member on to the rod.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A tool for adjusting the axial position of a threaded post comprising:

a collet having a first end with a surface configuration adapted to receive a torque applying driver, a second end having an outwardly flared portion with a largest diameter at said outwardly flared portion and an internal opening sized to receive said post with a minimum amount of play;

a ring having an internal diameter slightly larger than a diameter of said first end of said collet and smaller than said outwardly flared diameter carried on said collet between said first end and said second end and engaging said flared portion;

a sleeve carried on said collet between said first end and said ring;

means engageable between said collet and said sleeve for selectively retaining said sleeve on said collet in a fixed axial portion; and means for urging said sleeve and ring apart in an axial direction.

2. A tool according to claim 1, wherein said means for urging said ring and sleeve apart comprise jack screws threadingly received in said sleeve and engageable with said ring.

3. A tool according to claim 1, wherein said means for urging said ring and sleeve apart comprise a member between said ring and said sleeve axially expandable upon the introduction of pressurized hydraulic fluid therein.

4. A tool according to claim 1, wherein said means for urging said ring and sleeve apart comprises a rack and pinion mechanism engageable between said ring and said sleeve.

5. A tool according to claim 1, wherein said means for urging said ring and sleeve apart comprises a ratchet mechanism engageable between said ring and said sleeve.

6. A tool according to claim 1, wherein said means for selectively retaining said sleeve on said collet comprises a threaded external surface on said collet and an internal thread on said sleeve.

7. A tool according to claim 1, wherein said means for selectively retaining said sleeve on said collet comprises a threaded external surface on said collet and a threaded locking ring engageable against said sleeve.

8. A tool according to claim 1, wherein said means for selectively retaining said sleeve on said collet comprises an annular groove on said collet and a snap ring sized to be received therein and engageable against said sleeve.

9. A tool according to claim 1, wherein said means for selectively retaining said sleeve on said collet comprises segmented flanges protruding outwardly from a peripheral surface of said collet and segmented flanges protruding inwardly from said internal diameter of said sleeve, said flanges rotatable into axially interfering positions as in a bayonet mount.

10. A tool according to claim 1, wherein said means for selectively retaining said sleeve on said collet comprises a continuous flange protruding outwardly from a peripheral surface of said collet to engage said sleeve.

11. A tool according to claim 1, wherein said outwardly flared portion of said collet comprises a plurality of separate insert members carried by said collet to freely move radially, but which are prevented from moving laterally or longitudinally.

12. A tool according to claim 11, wherein a plurality of sets of inserts are provided which have different radial dimensions, each of said sets to be used to engage rods of different diameters.

13. A tool according to claim 1, wherein said outwardly flared portion is an integrally formed outer surface of said collet.

14. A tool according to claim 1 including a plurality of different cylindrical insert members having different radial thicknesses selectively fixedly held within said collet member to be used to engage rods of different diameters.

15. A tool for use in rotating a rod comprising:

a first sleeve member having a surface configuration adapted to receive a torque applying driver, a first and second axial end, said second end having a portion which is outwardly flared with a largest diameter closest to said second end, and an internal opening leading from said second end and sized to receive said rod with a minimum amount of play;

a second sleeve member having an internal diameter smaller than said outwardly flared diameter carried on said first sleeve in engagement with said flared portion;

a third sleeve carried on said first sleeve between said first end and said second sleeve;

means engageable between said first sleeve and said third sleeve to selectively retain said third sleeve on said first sleeve in a fixed axial position; and means for urging said second and third sleeves apart in an axial direction.

16. A tool according to claim 15, wherein said means for retaining said first and third sleeves in a fixed axial position comprises said first sleeve including a section having an external thread thereon between said first end and said flared portion and said third sleeve having an internal thread matching with said external thread.

17. A tool according to claim 15, wherein said means for urging said second and third sleeves apart comprise jack screws carried on said third sleeve and engageable with said second sleeve.

18. A tool according to claim 5, wherein said internal opening comprises a blind hole.

19. A tool according to claim 5, wherein said second sleeve member comprises a split ring held in a closed position by a laterally extending fastening means.

20. A tool for axially rotating a rod comprising:

a first sleeve member having a first end with a surface configuration adapted to receive a torque applying driver, a second end having a portion which is outwardly flared with a largest diameter closest to said second end, and an internal opening leading from said second end and sized to receive said rod with a minimum amount of play;

a second sleeve member having an internal diameter slightly smaller than said outwardly flared diameter and being carried on said first sleeve in engagement with said flared portion;

a third sleeve carried on said first sleeve adjacent to said second sleeve, on the side closest to said first end, means engageable between said first sleeve and said third sleeve for selectively retaining said third sleeve on said first sleeve in a fixed axial position; and means for urging said second and third sleeves apart in an axial direction.

21. A tool according to claim 20, wherein said means for holding said first and third sleeves in a fixed axial position comprises said first sleeve including a section having an external thread thereon between said first end and said flared portion and said third sleeve having an internal thread matching with said external thread.

22. A tool according to claim 10, wherein said first sleeve internal opening has a surface with a friction enhancing contour.

23. A tool according to claim 20, wherein said means for urging said second and third sleeves apart comprise jack screws carried on said third sleeve and engageable with said second sleeve.

24. A tool according to claim 20, wherein said means for urging said second and third sleeves apart comprise a plurality of longitudinally extendable members engageable between said second and third sleeves.

25. A tool for use in rotating a rod comprising:

a first member having a first and second axial end, said second end having a tapered portion, and an internal opening leading from said second end and sized to receive said rod with a minimum amount of play;

a second member surrounding said first member and having an internal surface area shaped complementarily to and being in engagement with said tapered portion of said first member;

a third member;

means engageable between said third member and one of said first and second members for retaining said third member and said one of said first and second members in a fixed positional relationship; and means for urging said third member and an other of said first and second members apart in an axially direction.

26. A tool according to claim 25, wherein said first, second and third members are each cylindrical sleeves with open interiors.

27. A tool according to claim 25, wherein said third member is held fixed in relationship to said first member and is urged apart from said second member.

28. A tool according to claim 25, wherein said third member is held fixed in relationship to said second member and is urged apart from said first member.

29. A tool according to claim 25, wherein said third member is carried on an external surface of said first member.

30. A tool according to claim 25, wherein said third member is carried on an internal surface of said second member.

* * * * *